US005857439A

United States Patent [19]

Will et al.

[11] Patent Number: 5,857,439

[45] **Date of Patent: *Jan. 12, 1999**

[54] CONTROLLED NOISE PORTABLE POWER UNIT FOR OPERATING A TOOL

[75] Inventors: Lawrence N. Will, Spring Grove; Mark Smolenski, Bartlett, both of Ill.

[73] Assignee: Kioritz Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 862,097

[22] Filed: May 22, 1997

[51] Int. Cl.[6] ..... F02M 31/00

[52] U.S. Cl. ..... 123/184.21; 123/2; 204/181

[58] Field of Search ..... 123/2, 184.61, 123/184.21, 198 E; 181/204, 210, 292

[56] References Cited

U.S. PATENT DOCUMENTS 5,195,208 3/1993 Yamami et al. ..... 15/326

FOREIGN PATENT DOCUMENTS 5-14000 4/1993 Japan .

OTHER PUBLICATIONS

ECHO® 1992 Master Products Catalogue Part No. 999222–00910 pp. 15–19, 23.

*Primary Examiner*—Marguerite McMahon

*Attorney, Agent, or Firm*—Armstrong, Westerman, Hattori, McLeland and Naughton

[57] ABSTRACT

A portable power unit for operating a tool is provided and includes a frame adapted to be carried on the back of an operator to orient the power unit in a the predetermined operating position with the operator standing upright. The power unit further includes an engine mounted on the frame for powering a tool, a fan mounted between the frame and the engine, a fan intake positioned between the frame and the fan, and structure for attenuating engine and fan generated noise and for inhibiting the emanation of engine and fan generated noise in horizontal directions from the power unit with the power unit in the operating position.

4 Claims, 6 Drawing Sheets

CONTROLLED NOISE PORTABLE POWER UNIT FOR OPERATING A TOOL

FIELD OF THE INVENTION

This invention relates to portable power tools, and more particularly, to portable power units that are carried on a backpack frame for operating a power tool.

BACKGROUND OF THE INVENTION

Portable power tools are often utilized in areas, such as in enclosed indoor facilities or outdoors in residential neighborhoods, where the noise generated by the power tool may create a health risk and/or a public nuisance. The noise emanating in horizontal directions from portable power tools is especially critical because this noise tends to directly impact upon the people located in the vicinity of the power tool. In recognition of this phenomenon, standards and local ordinances restricting the maximum acceptable noise level from portable power tools are becoming increasingly common. One example of a standard is ANSI B175.2-1996 issued by the American National Standard Institute.

Power blowers are one example of a portable power tool where noise is of special concern. In addition to the noise generated by the engine, power blowers also produce noise from the blower fan and the associated air flow. Noise is especially problematic for power blowers utilizing a backpack mounted engine and fan unit because, typically, such blowers utilize a relatively large engine and have a relatively large air flow.

While some conventional portable power tools, including backpack mounted power blowers, are capable of meeting at least some of the current standards and ordinances, there is a continuing desire to reduce the noise associated with such tools.

SUMMARY OF THE INVENTION

In accordance with the present invention, a portable power unit for operating a tool is provided and includes a frame adapted to be carried on the back of an operator to orient the power unit in a predetermined operating position with the operator standing upright. The power unit further includes an engine mounted on the frame for powering a tool, a fan mounted between the frame and the engine, a fan intake positioned between the frame and the fan, and structure for attenuating fan generated noise and for inhibiting the emanation of fan generated noise in horizontal directions from the power unit with the power unit in the operating position.

In one form the structure includes a pair of barriers positioned on opposite sides of the fan intake, each of the barriers extending in a substantially vertical plane with the power unit in the operating position.

In one form, the barriers comprise foam pads.

In one form, the structure further includes rubber sheets laminated on each of the pads.

In one form, the structure further includes a third foam pad positioned above the fan intake with the power unit in the operating position.

In one form, a portable power unit for operating a tool is provided and includes a frame adapted to be carried on the back of an operator to orient the power unit in a predetermined operating position with the operator standing upright. The power unit further includes an engine mounted on the frame for powering a tool, a combustion air intake for directing combustion air to the engine, and structure mounted in the air intake for attenuating engine generated noise.

In one form, the attenuating structure includes a diffuser screen comprising flat, elongate filaments.

In one form, the filaments are woven into a mesh.

In one form, a portable power unit for operating a tool is provided and includes a frame adapted to be carried on the back of an operator to orient the power unit in a predetermined operating position with the operator standing upright. The power unit further includes an engine mounted on the frame for powering a tool. The engine includes a cylinder head and a crank case. The power unit further includes structure for attenuating engine generated noise and for inhibiting the emanation of engine generated noise in horizontal directions from the power unit with the power unit in the operating position. The structure includes substantially imperforate wall sections surrounding the cylinder head and the crank case. The wall sections extend in substantially vertical planes with the power unit in the operating position.

In one form, structure comprises foam material mounted between the wall sections and the engine.

In one form, the foam material comprises melamine foam.

In one form, the wall sections comprise toughened nylon.

In one form, the power unit further includes structure for directing a cooling flow over the cylinder head and then downwardly from the engine in a substantially vertical direction.

In one form, a portable power unit for operating a tool is provided and includes a frame adapted to be carried on the back of an operator to orient the power unit in an operating position with the operator standing upright. The power unit further includes an engine mounted on the frame for powering a tool, and structure for attenuating engine generated noise and for inhibiting the emanation of engine generated noise in horizontal directions from the power unit with the power unit in the predetermined operating position. The structure includes an engine cover surrounding the engine. The structure further includes foam material mounted between the engine cover and the engine.

In one form, the engine cover comprises substantially imperforate surfaces.

In one form, the engine cover comprises toughened nylon.

In one form, the engine includes a spark plug and the engine cover includes an opening for allowing access to the spark plug. The power unit further includes second structure mounted on the engine cover over the opening for attenuating engine generated noise emanating from the opening.

In one form, the power unit further includes structure for directing a cooling air flow over the engine and then downwardly from the engine in a substantially vertical direction.

DETAILED DESCRIPTION OF THE PREFERRED EMBODIMENT

Figure 1:
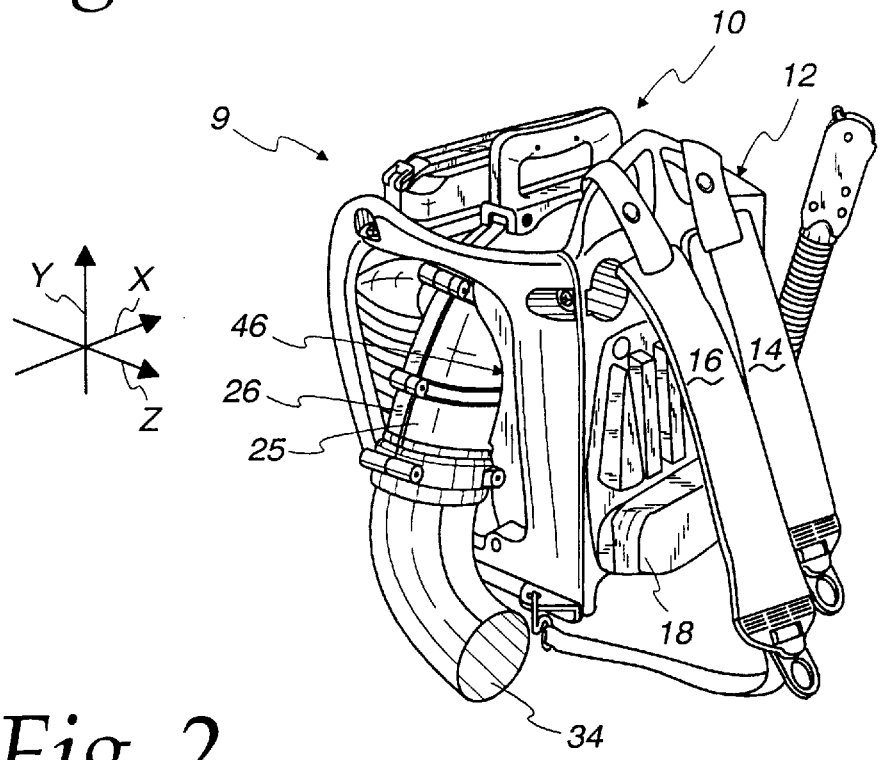
FIG. 1 is a perspective view from the front and right side of a portable power unit embodying the present invention.
Figure 2:
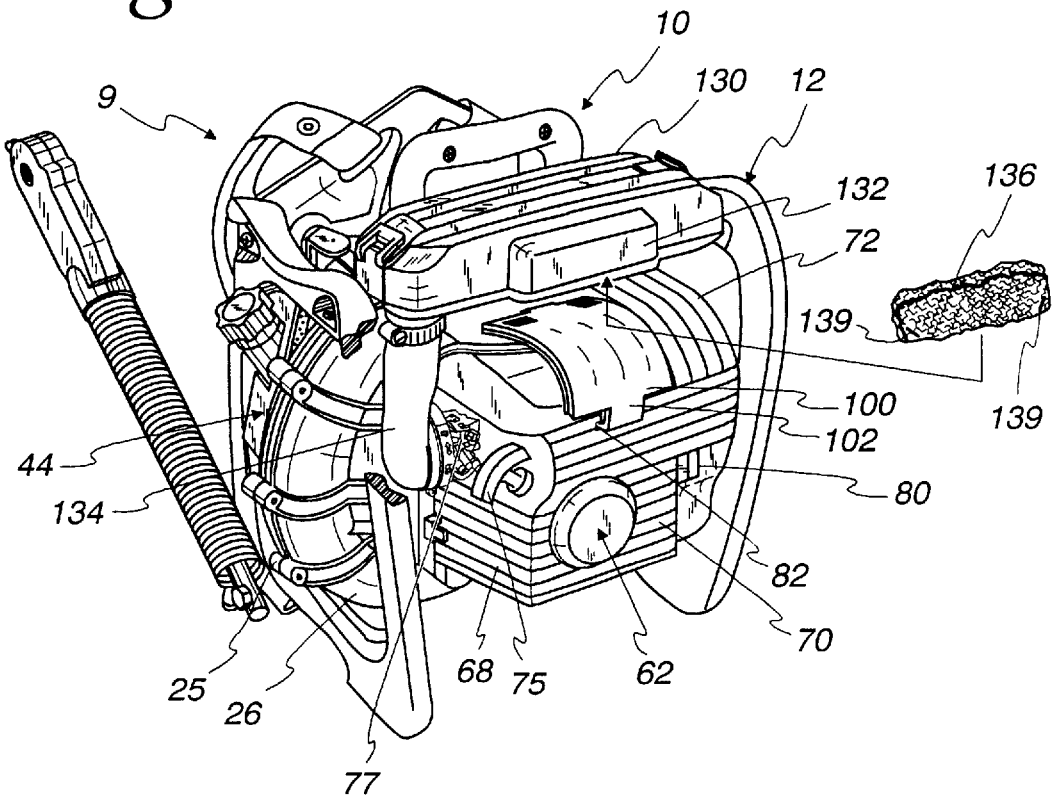
FIG. 2 is a perspective view from the back and left side of the portable power unit shown in FIG. 1, with a portion of the blower shown exploded.

As shown in FIGS. 1 and 2, the invention is embodied in a portable power unit 9 shown in the form of a portable power blower 10 including a frame 12, adapted to be carried on the back of an operator to orientate the power blower 10 in a predetermined operating position with the operator standing upright. More specifically, the frame 12 includes a pair of shoulder strap pads 14, 16 and a back support 18. When the frame is carried on the back of an operator and the operator is standing upright, the shoulder strap pad 14 is bearing against the left shoulder of the operator, the shoulder strap pad 16 is bearing against the right shoulder of the operator, the back support 18 is bearing against the back of the operator, and the power blower 10 is oriented in the operating position shown in FIG. 1, with the arrow Y indicating vertical and the arrows X and Z indicating horizontal.

Figure 7:
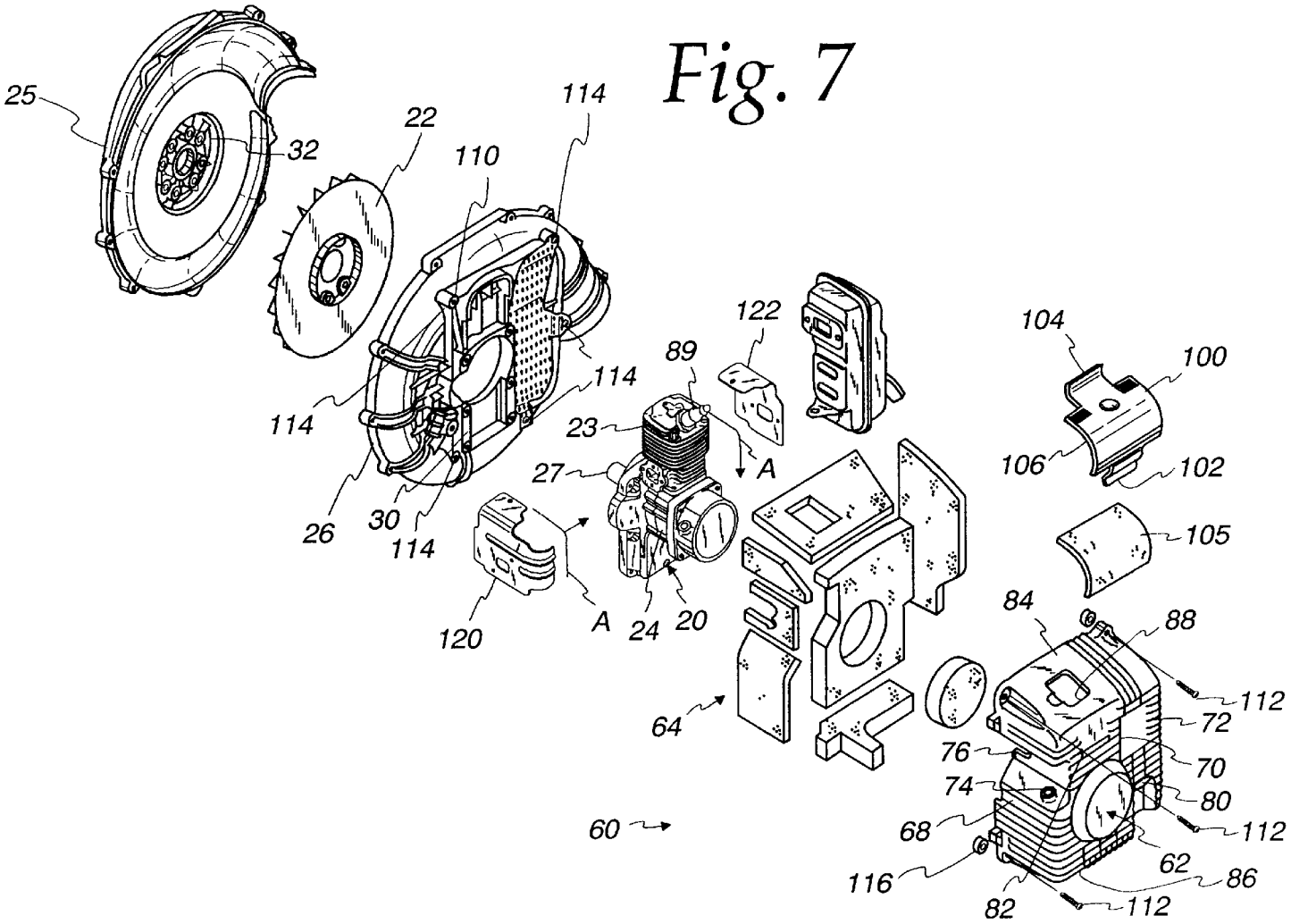
FIG. 7 is an exploded perspective view showing a noise attenuating engine cover, noise attenuating foam pads for the engine cover, a spark plug opening cover and associated noise attenuating pad, an engine, a muffler, cooling air flow diverters, fan housings, and a fan on the portable power unit in FIG. 1.
Figure 8:
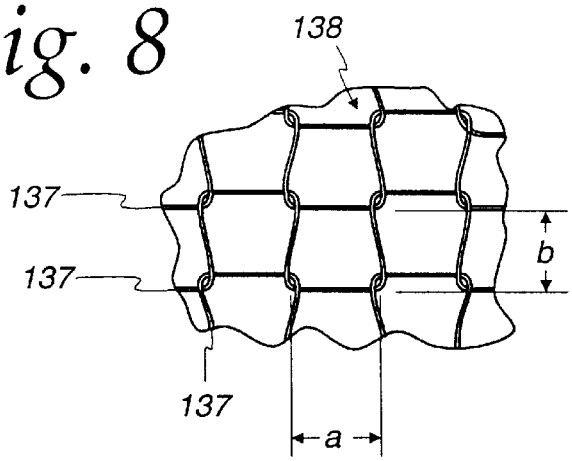
FIG. 8 is an enlarged section view taken from line 8—8 in FIG. 5 showing the details of a diffuser screen of the portable power unit.
Figure 9:
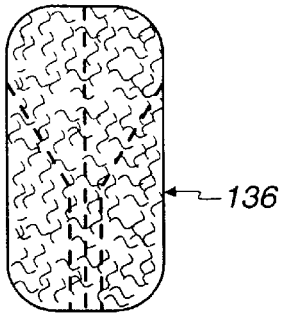
FIG. 9 is an end view of the diffuser screen of the portable power unit in FIG. 1.
Figure 10:
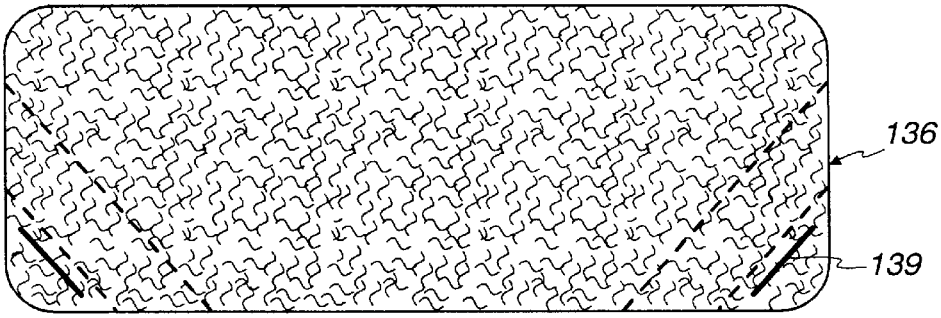
FIG. 10 is an elevation view of the diffuser screen shown in FIG. 9.
Figure 11:
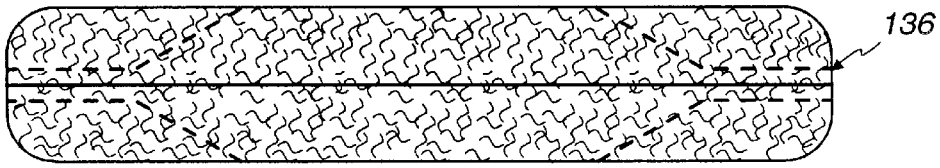
FIG. 11 is a bottom view of the diffuser screen shown in FIG. 9.

As best seen in FIG. 7, the power blower 10 also includes an engine 20 mounted on the frame 12 for powering a tool shown in the form of a fan 22. The engine 20 includes a cylinder head 23 and a crank case 24. The fan 22 is enclosed between a front fan housing 25 and a back fan housing 26. The fan 22 is mounted on and driven by a crank shaft 27 of the engine 20.

While the power unit 9 is described and illustrated herein in the form of the power blower 10, it should be understood that the power unit 9 may be used to operate tools other than a blower (e.g., a weed cutting tool, a hedge trimming tool, a drilling tool, a powered spraying tool, etc.) and that no limitation to use as a power blower is intended.

Figure 3:
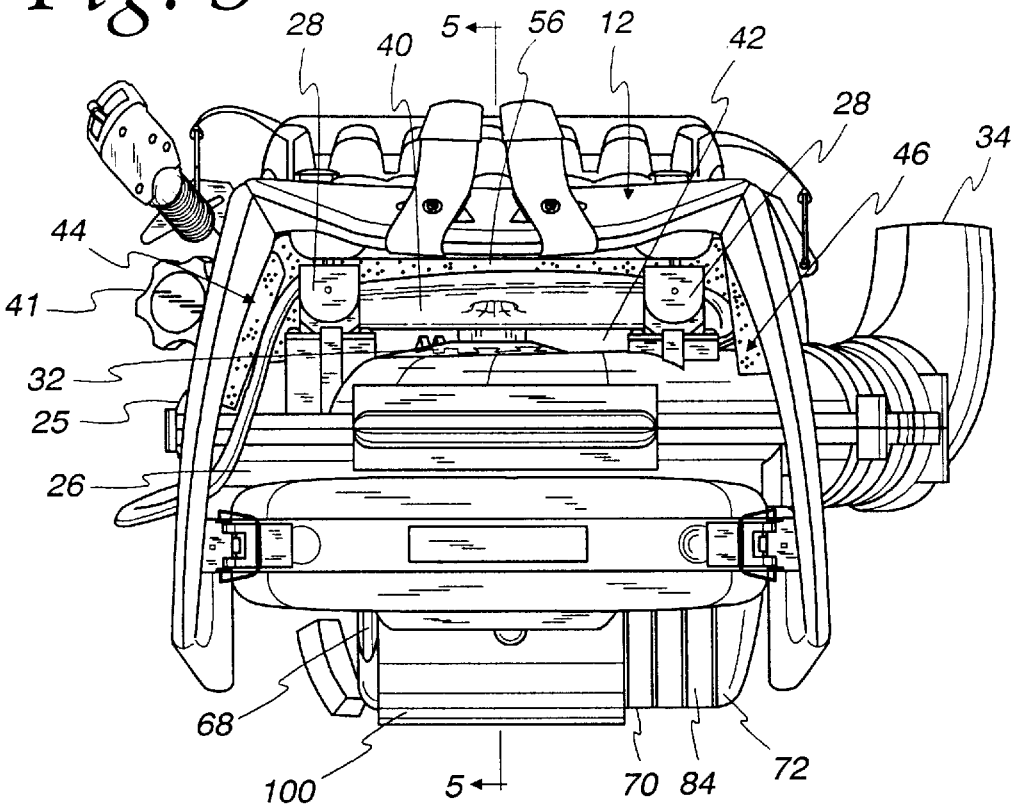
FIG. 3 is a plan view of the portable power unit in FIG. 1.
Figure 4:
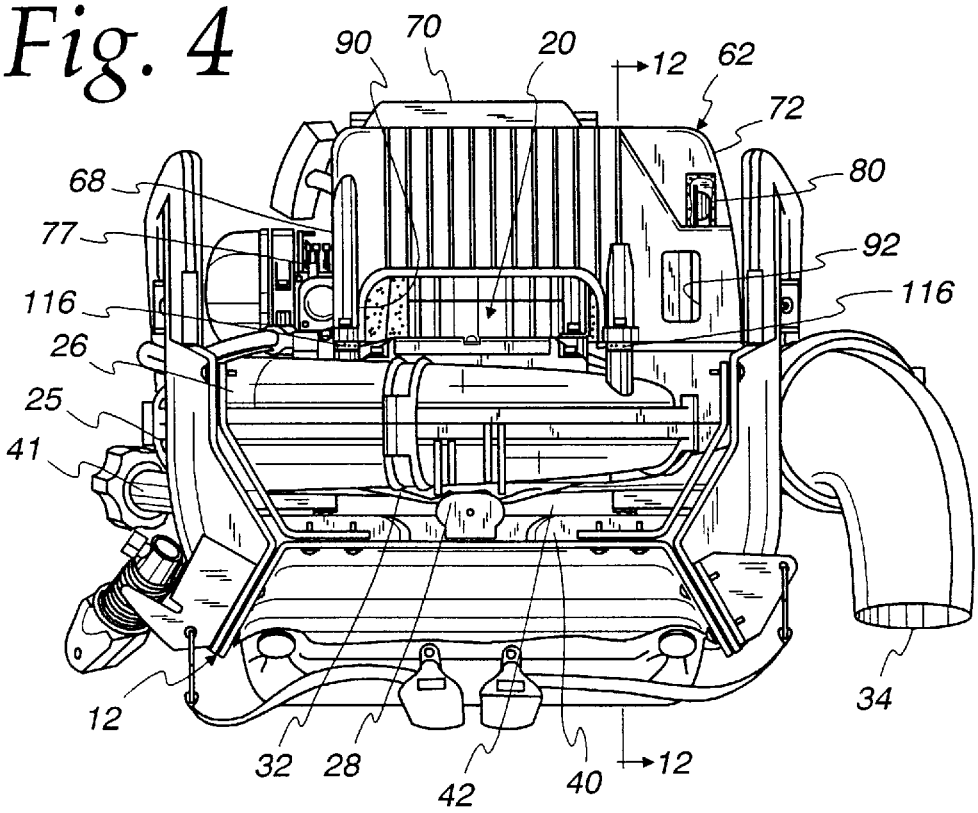
FIG. 4 is a bottom view of the portable power unit in FIG. 1.

As best seen in FIGS. 3 and 4, the fan housings 25, 26 are mounted to the frame by three elastomeric vibration isolation mounts 28, as is known. As best seen in FIG. 7, the engine 20 is bolted to flange surfaces 30 on the back fan housing 26. A fan intake 32, best seen in FIG. 7, is provided in the front fan housing 25 to allow an air flow to be drawn by the fan 22 into the fan housings 25, 26 and exhausted from the fan housings 25, 26 at an exhaust port 34. Thus, the fan 22 is mounted between the frame 12 and the engine 20, and the fan intake 32 is positioned between the frame 12 and the fan 22.

Preferably, the fan housings 25, 26 are made from toughened nylon 6 with glass.

As best seen in FIGS. 3 and 4, the power blower 10 further includes a fuel tank 40 mounted directly to the frame 12. The fuel tank 40 includes a fill spout 41 and is spaced forward from the air intake 32 to allow a vertically extending air gap 42 between the front fan housing 25 and the frame 12.

Figure 6:
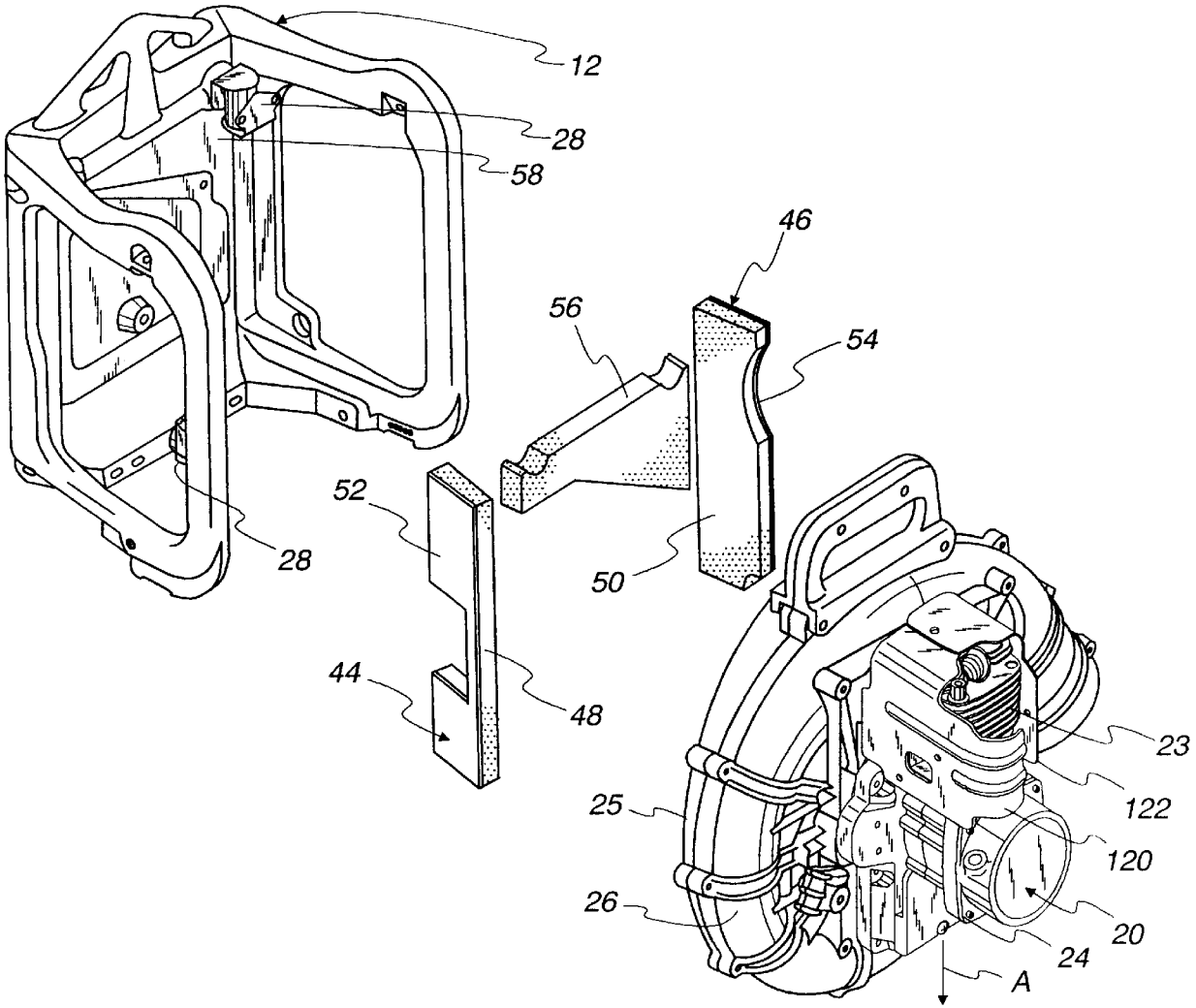
FIG. 6 is an exploded perspective view showing a backpack frame, a fan housing, an engine, and noise attenuating barriers of the portable power unit in FIG. 1.

As best seen in FIG. 6, the power blower 10 also includes means, shown in the form of vertical barriers 44 and 46, for attenuating fan generated noise and for inhibiting the emanation of fan generated noise in horizontal directions from the power blower 10 with the power blower 10 in the operating position. As best seen in FIGS. 1, 2 and 3, the barriers 44, 46 are positioned on opposite sides of the fan intake 32 and extend in substantial vertically planes with the power blower 10 in the operating position to enclose each vertical side of the air gap 42. The barriers 44, 46 are shaped to conform to the frame 12 and the front fan housing 25 so that the barriers 44, 46 are trapped in their assembled positions between the frame 12 and the front fan housing 25. Preferably, as seen in FIG. 6, the barriers 44, 46 are formed respectively from closed cell foam pads 48, 50 and rubber sheets 52, 54 laminated on each of the pads 48, 50. This construction has proven advantageous for attenuating fan generated noise and for inhibiting the emanation of fan generated noise in horizontal directions from the power blower 10. Additionally, because the foam pads 48, 50 and rubber sheets 52, 54 are relatively resilient, the barriers 44, 46 do not unduly interfere with the vibration isolating function of the isolation mounts 28.

Preferably, as best seen in FIGS. 3 and 6, a third closed cell foam pad 56 may be mounted directly against a surface 58 of the frame 12 with pressure sensitive adhesive so that the pad 56 is positioned above the fan intake 32 with the power blower 10 in the operating position. Again, this construction has proven advantageous for attenuating fan generated noise and for inhibiting the emanation of fan generated noise in the vertically upward direction from the power blower 10 with the power blower 10 in the operating position.

As best seen in FIG. 7, the power blower 10 further includes means, shown generally at 60, for attenuating engine generated noise and for inhibiting the emanation of engine generated noise in horizontal directions from the power blower 10 with the power blower 10 in the operating position. The means 60 includes an engine cover 62 that surrounds the engine 20. Preferably, the means 60 also includes foam pads 64 that are mounted between the engine cover 62 and the engine 20 to aid in the attenuation of noise. Preferably, the engine cover 62 is a unitary construction made of toughened nylon and the foam pads 64 are made of melamine foam and adhesively bonded to the interior surface of the engine cover 62 so that they cover essentially all of the interior surface of the engine cover 62.

As best seen in FIGS. 4 and 7, the engine cover 62 includes three substantially imperforate wall sections 68, 70 and 72 that surround the cylinder head 23 and the crank case 24. The wall sections 68, 70, 72 extend in a substantially vertical planes with the power blower 10 in the operating position to inhibit the emanation of engine generated noise in horizontal directions from the power blower 10. While the wall section 68 is substantially imperforate, the wall section 68 does include an opening 74 for a cord attached to an engine starter pull handle 75, and a cutout 76 that allows clearance past a carburetor 77 attached to the engine 20, as best seen in FIGS. 2 and 7. Similarly, although the wall section 70 is substantially imperforate, the wall section 70 does include an opening 80 that allows the engine exhaust to escape from the engine cover 62. The wall section 70 also includes a slot 82, the significance of which will be explained below.

The engine cover 62 further includes a top wall section 84 and a bottom wall section 86, both of which extend in substantially horizontal planes with the power blower 10 in the operating position. While the top wall section 84 is substantially imperforate, as best seen on FIG. 7, the wall section 84 does include an opening 88 that allows access to a spark plug 89 in the engine 20. Similarly, while the bottom wall section 86 is substantially imperforate, it does include openings 90 and 92 that serve as vents for a cooling air flow, as best seen in FIG. 4.

As best seen in FIGS. 3 and 7, a barrier 100 is mounted on the engine cover 62 over the opening 88 for attenuating engine generated noise emanating from the opening 88. The barrier 100 includes a tab 102 that is received in the opening 82 of the cover 62, and a tab 104 that is received in the opening 88 of the cover 62 to retain the barrier 100 to the cover 62. A foam pad 105 having a generally conforming shape to the barrier 100 is adhesively bonded to a bottom surface 106 of the barrier 100. The foam pad 105 helps to attenuate engine generated noise emanating from the opening 88. Preferably, the barrier 100 is made of toughened nylon and the foam pad 105 is made of melamine foam.

As best seen in FIG. 7, the back fan housing 26 is provided with a flange 110 for mounting the engine cover 62 to the back fan housing 26. The cover 62 is attached to the flange 110 by a plurality of threaded fasteners 112 that are received in threaded openings 114 provided in the flange 110. Foam washers 116 are provided between the cover 62 and the flange 110 at each of the fasteners 112. Preferably, the fasteners 112 are made from nylon 6 with glass reinforcement and the foam washers are made from an elastomeric foam to attenuate the transfer of vibrational energy between the cover 62 and the fan housing 26.

Figure 12:
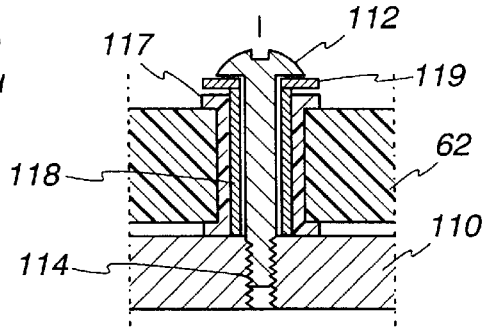
FIG. 12 is an enlarged partial section view of the portable power unit taken along line 12—12 in FIG. 4.

FIG. 12 illustrates an alternate embodiment for mounting the engine cover 62 to the back fan housing 26. In this embodiment, cylindrical rubber bushings or grommets 117 are provided in the engine cover 62 to attenuate the transfer of vibrational energy between the cover 62 and the fan housing 26. The fasteners 112 clamp to the flange 110 through an aluminum spacing collar 118 and a washer 119. The collar 118 is slightly longer than the thickness of the engine cover 62 and the grommet 117. This allows the engine cover 62 to "float" on the grommet 117, thereby reducing vibration and sound. Preferably, in this embodiment, the fasteners 112 are made from a suitable steel and the spacer collar 118 is made from aluminum.

As best seen in FIG. 6, air/flow deflector plates 120 and 122 are mounted on the cylinder head 23. The director plates 120, 122 serve, in combination with the cover 62 and the pad 64, to direct a cooling air flow from the fan 22 over the engine 20 and then vertically downward from the engine through the openings 90, 92 in the cover 62, as indicated by the arrows A in FIGS. 6 and 7. Preferably, the deflector plates are made of stamped sheet metal and also act as heat shields.

It should be appreciated that when the engine cover 62 is mounted to the fan housing 26 over the engine 20, the engine 20 is substantially enclosed by the cover 62 and the housing 26, with only the openings 80, 90 and 92 providing an unobstructed path for noise emanating from the engine 20, as best seen in FIGS. 2–4. The cutout 76 is essentially closed by the carburetor 77. The slot 82 is blocked by the pads 64 and the tab 102. The opening 88 is obstructed by the barrier 100. Thus, the cover 62, the barrier 100, the pad 104, the pads 64 and the fan housing 26 all serve to attenuate the engine generated noise and to inhibit the emanation of engine generated noise from the power blower 10, especially the emanation of engine generated noise in horizontal directions when the power blower 10 is in the operation position.

Figure 5:
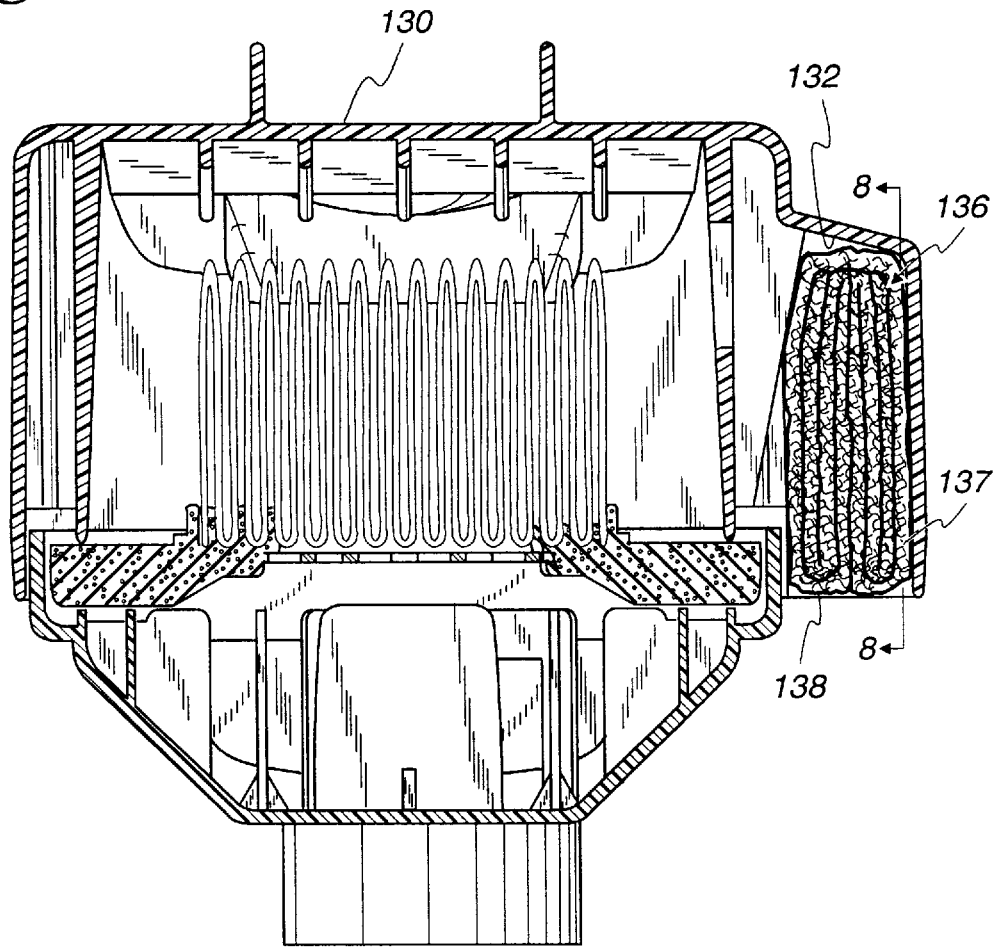
FIG. 5 is an enlarged partial section view of the portable power unit taken along line 5—5 in FIG. 3.

As best seen in FIG. 2, an air filter housing 130 is mounted directly to the frame 12 and includes a combustion air intake 132. Combustion air is directed from the air filter housing 130 to the carburetor 77 by a rubber hose 134. As best seen in FIGS. 2 and 5, a diffuser screen 136 of approximately the same size and shape as the combustion air intake 132 is mounted in the air intake 132 for attenuating engine generating noise. As best seen in FIGS. 5 and 8–11, the diffuser screen 136 is formed from elongate filaments 137 that have been woven into a mesh layer 138 which is then folded upon itself a number of times and secured with staples 139 to produce the overall shape of the diffuser screen 136. In other words, the diffuser screen 136 is formed in a manner similar to a household dishwashing scrub pad such as, for example, a Brillo® type scrub pad. The phantom lines in FIGS. 9–11 indicate generally the deformation of the diffuser screen 136 adjacent the staples 139. The diffuser screen 136 is slightly compressed when inserted into the air intake 132 and is retained in the air intake 132 by the frictional forces acting between the filaments 137 and the combustion air intake 132. While any material capable of attenuating noise may be used, it is preferred that the elongate filaments 137 be formed from copper, stainless steel or plastic because these materials do not tend to corrode or absorb moisture. In one preferred embodiment, the mesh layer 138 has dimensions "a" and "b" that are approximately equal to 0.200" and the filaments 137 are formed from flat copper wire having a cross section thickness of approximately 0.0004" and a cross section width of approximately 0.0130". However, it should be understood that the elongate filaments 137 may have other cross-sectional shapes and compositions, including round filaments 137.

It should be appreciated that the noise generated by the power unit 9 is attenuated and inhibited from emanating from the power unit 9, especially in horizontal directions with the power unit 9 in the predetermined operating position, by providing the portable power unit 9 with features such as the barriers 44 and 46, the pad 56, the engine cover 62, the foam pads 64, the barrier 100, and the diffuser screen 136.

We claim:

1. A portable power unit for operating a tool, said portable power unit comprising:

a frame adapted to be carried on the back of an operator to orient the power unit in a predetermined operating position with the operator standing upright;

an engine mounted on the frame for powering a tool;

a combustion air intake for directing combustion air to the engine; and means mounted in the air intake for attenuating engine generated noise wherein said attenuation means comprises a diffuser screen comprising elongate filaments.

2. The power unit of claim 1 wherein the filaments are woven into a mesh.

3. The power unit of claim 1 wherein the filaments are flat elongate filaments.

4. The power unit of claim 1 wherein the filaments are round elongate filaments.

* * * * *